United States Patent [19]

Nagai

[11] Patent Number: 4,616,941

[45] Date of Patent: Oct. 14, 1986

[54] THERMAL DOT TYPE PRINTING APPARATUS

[75] Inventor: Junshiro Nagai, Shizuoka, Japan

[73] Assignee: Tokyo Electric Co., Ltd., Tokyo, Japan

[21] Appl. No.: 712,393

[22] Filed: Mar. 15, 1985

[30] Foreign Application Priority Data

Mar. 26, 1984 [JP] Japan ..... 59-57759

[51] Int. Cl.[4] ..... B41J 3/12; B41J 3/20

[52] U.S. Cl. ..... 400/120; 346/76 PH; 400/54

[58] Field of Search ..... 400/54, 120; 346/76 PH; 219/216 PH

[56] References Cited

U.S. PATENT DOCUMENTS

| | | | |
|---|---|---|---|
| 4,284,876 | 8/1981 | Ishibashi | 400/120 X |
| 4,409,599 | 10/1983 | Yasuda | 346/76 PH |
| 4,415,904 | 11/1983 | Inui | 346/76 PH X |
| 4,415,907 | 11/1983 | Suemori | 346/76 PH |
| 4,456,392 | 6/1984 | Nozaki | 400/120 |
| 4,464,669 | 8/1984 | Sekiya | 346/76 PH |
| 4,524,368 | 6/1985 | Inui | 346/76 PH |
| 4,536,774 | 8/1985 | Inui | 346/76 PH |

FOREIGN PATENT DOCUMENTS

| | | | |
|---|---|---|---|
| 113556 | 4/1978 | Japan | 400/120 |

*Primary Examiner*—Paul T. Sewell

*Attorney, Agent, or Firm*—Frishauf, Holtz, Goodman & Woodward

[57] ABSTRACT

A thermal dot type printing apparatus includes a thermal head having N heating elements arranged in a line, a head driver which allows a current to selectively flow through the heating elements in accordance with N-bit dot data, and a control circuit for sequentially supplying a plurality of N-bit dot data constituting the character data to be printed to the head driver. This printing apparatus further has a counter for counting the total number of heating elements energized by the head driver in a unit time. The control circuit supplies a control signal in accordance with a count data of the counter to the head driver, thereby reducing the current which is supplied to the heating elements upon printing operation.

18 Claims, 7 Drawing Figures

THERMAL DOT TYPE PRINTING APPARATUS

BACKGROUND OF THE INVENTION

The present invention relates to a thermal dot type printing apparatus in which overheating of the thermal print head is prevented.

There is known a thermal dot type printing apparatus in which a carriage is moved at a constant speed and current is allowed to pass through each heating element of a thermal print head mounted on the carriage for dot printing, thereby printing characters corresponding to printing data. In this type of printing apparatus, when the total number of heating elements which are energized in a unit time increases, the temperatures of the thermal print head and of the parts near the thermal print head also increase. When these temperatures increase and become higher than a preset limit value, the size of the dot which is printed becomes large, so that the printed characters become unclear and in the worst case, there is a risk that a print ribbon will melt due to the heat and become welded and deposited on a portion of the print head or on a printing paper.

To avoid such a problem, in a conventional thermal dot type printing apparatus, a temperature detecting element such as a thermistor is attached to the thermal print head and the amount of energy from a voltage which is applied to, or from a current which is allowed to flow through each heating element is changed in accordance with the temperature of the portion of the thermal print head.

However, the thermal dot type printing apparatus in which the temperature detecting element is attached to the thermal print head has the following problem. Namely, a temperature detecting element and a temperature detecting circuit which is connected to the temperature detecting element are costly; therefore, there is a problem such that the manufacturing cost of the overall thermal dot type printing apparatus and the cost of the printing apparatus increase.

On the other hand, if the printing time interval is set long for prevention of the increase in temperature of the thermal print head, a problem, arises that the printing speed contrarily slows down.

SUMMARY OF THE INVENTION

It is an object of the present invention to provide a low-priced thermal dot type printing apparatus in which an increase in temperature of a portion of a thermal print head can be suppressed without reducing the printing speed, by controlling energy which is supplied to heating elements in accordance with the total number of heating elements which are energized in a unit time.

This object is accomplished by a thermal dot type printing apparatus comprising: a thermal head having N heating elements arranged in a line; a head transfer unit to move this thermal head in the printing direction; a head driver unit to supply a current to the heating elements in accordance with N-bit dot data; a counting circuit to count the total number of heating elements energized by the head driver unit in a unit time; and a control circuit which supplies a control signal to the head driver unit when the control circuit detects that the count value of the counting circuit reaches a predetermined value, thereby controlling the current which is supplied to those heating elements upon printing operation.

In this invention, in accordance with the total number of heating elements energized in a unit time, the amount of current which is allowed to flow through these heating elements upon a printing operation is controlled. Therefore, in the case where the printing operation is continuously executed at a high density, the current which is allowed to flow through those heating elements upon printing operation is reduced at an early time, thereby preventing the temperature of the thermal head from increasing.

DETAILED DESCRIPTION OF THE PREFERRED EMBODIMENTS

Figure 1:
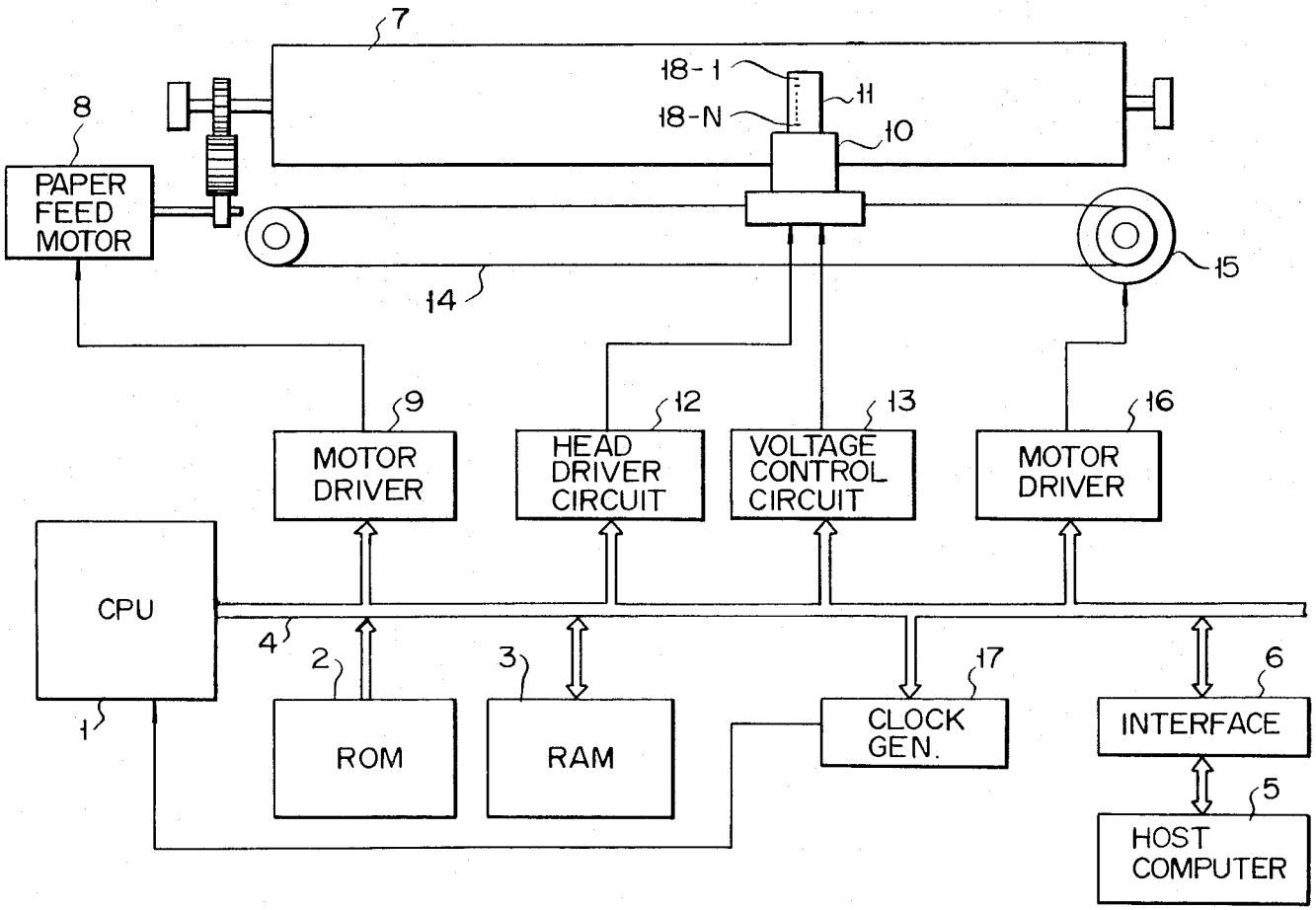
FIG. 1 shows a thermal dot type printing apparatus according to one embodiment of the present invention.

FIG. 1 schematically shows a thermal dot type printing apparatus according to one embodiment of the present invention. This printing apparatus includes a central processing unit (CPU) 1; a read only memory (ROM) 2 which is coupled to the CPU 1 through a data bus 4 to store a control program and a fixed data such as dot patterns, each of which corresponds to each character code and which are indicated in a matrix form; and a random access memory (RAM) 3 to temporarily store variable data such as ASCII codes including character codes which are supplied from the outside. Also, a host computer 5 to supply the ASCII codes through an interface 6 is coupled to the CPU 1.

In addition, a paper feed motor driver 9 to control a paper feed motor 8 to rotate a platen 7 onto which a print paper is set, a print head driver circuit 12 to drive a thermal print head 11 mounted on a carriage 10, a voltage control circuit 13 to control a voltage which is supplied to the head 11, a carriage motor driver 16 to drive a carriage motor 15 to move the carriage 10 attached to a rotary belt 14 along the platen 7, and a clock generator 17 to produce a clock signal of a period of 0.1 second, are connected to the CPU 1 through the data bus 4.

For instance, eight to twelve heating elements 18-1 to 18-N for dot printing are arranged in the thermal print head 11 in a longitudinal line.

Figure 2:
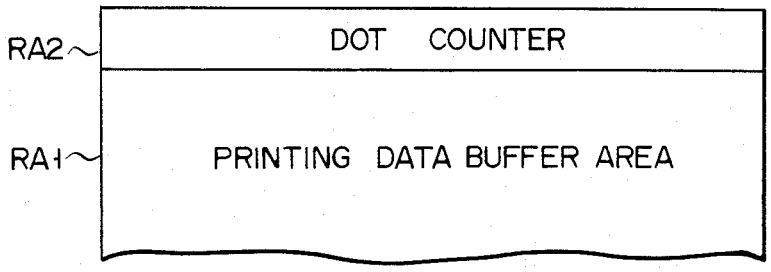
FIG. 2 shows a map of a RAM which is used in the printing apparatus shown in FIG. 1.

As shown in FIG. 2, a printing data buffer RA1 to store the ASCII codes including character codes which are supplied from the host computer 5 through the interface 6, and a dot counter RA2 to count the total number of heating elements 18-1 to 18-N which are selectively energized in accordance with the printing data, namely, the number CD of printed dots, are formed in the RAM 3.

Figure 3:
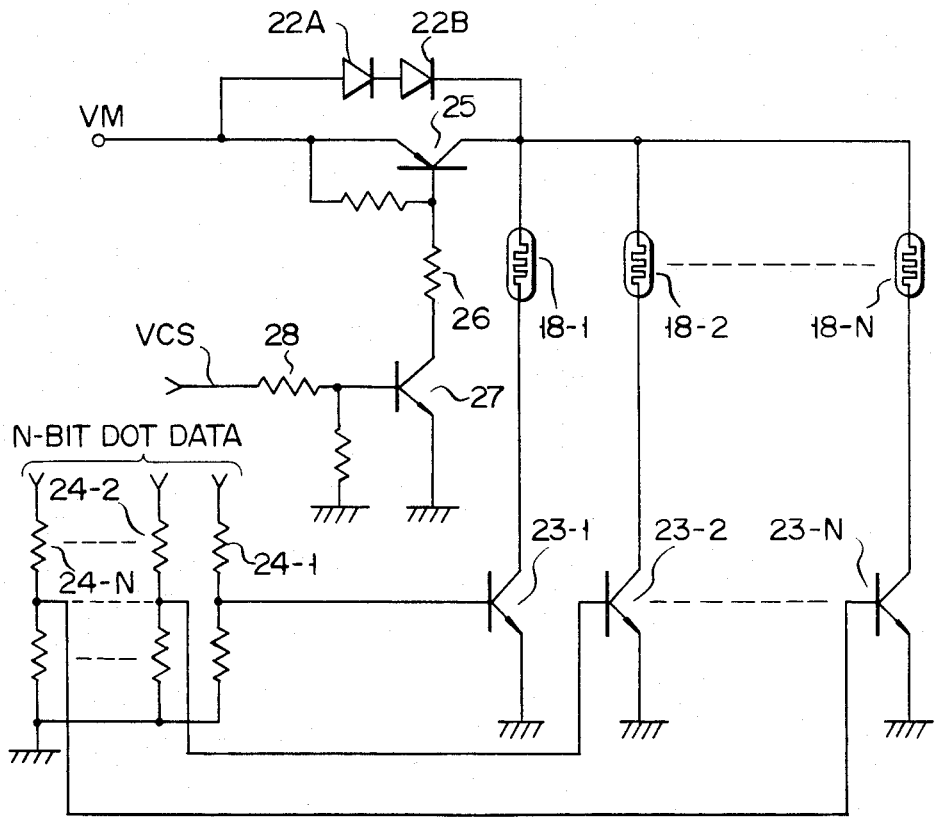
FIG. 3 is a circuit diagram of a voltage control circuit for use in the printing apparatus shown in FIG. 1.

FIG. 3 is a circuit diagram of the voltage control circuit 13. In this voltage control circuit, one end of each of the heating elements 18-1 to 18-N of the thermal print head 11 is connected through diodes 22A and 22B for a voltage drop to a power source terminal VM to which a DC voltage of, e.g., 8 V is applied. The other ends of the heating elements 18-1 to 18-N are grounded through collector-emitter paths of npn transistors 23-1 to 23-N, respectively. The N dot data included in the printing data are supplied through resistors 24-1 to 24-N to bases of the transistors 23-1 to 23-N, respectively.

A current path of a pnp transistor 25 for a bypass is connected across both ends of the voltage drop diodes 22A and 22B. A base of the transistor 25 is connected through a resistor 26 to a collector of a transistor 27. A voltage control signal VCS to control the voltage which is applied to each of the heating elements 18-1 to 18-N is supplied through a resistor 28 to a base of the transistor 27.

Figure 4:
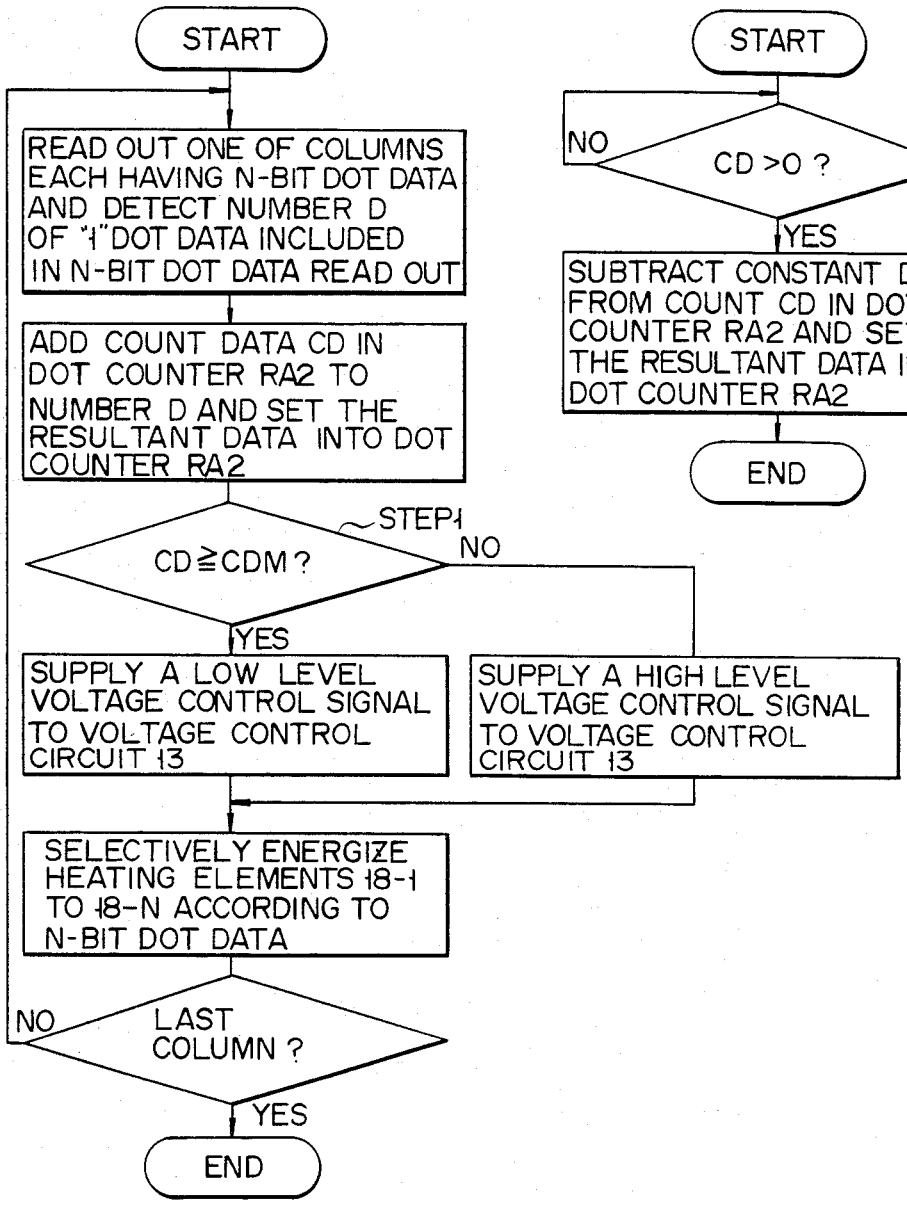
FIG. 4 is a flow chart for explaining the fundamental operation of a CPU in the printing apparatus shown in FIG. 1.

The CPU 1 is constituted in a manner such that when the character code representing a character to be printed is supplied from the host computer 5 through the interface 6, the CPU 1 executes the printing operation in accordance with a flow chart of FIG. 4. Practically speaking, when the character code is inputted, the CPU 1 sequentially reads out the N-bit dot data of M columns indicative of the first to M-th column of a character to be printed and also supplies each N-bit dot data to the head driver circuit 12. The CPU 1 then detects the number D of dot data "1" included in each N-bit dot data and sets the number D into its own counter. This number D represents the number of heating elements which are energized among the heating elements 18-1 to 18-N in order to print the N-bit dot data in each column of the foregoing character. Thereafter, the CPU 1 adds the number D held in the counter of the CPU 1 to the count data CD which corresponds to the total number of dots having been printed in a unit time and which is stored in the dot counter RA2 in the RAM 3, and sets this total data as a new count data CD into the dot counter RA2. Thereafter, the CPU 1 checks to see if the resultant count data CD obtained by the addition in STEP 1 has reached a predetermined maximum value CDM. When it is detected that the count data CD is smaller than the maximum value CDM, the CPU 1 determines that the temperature of the thermal print head 11 does not reach the upper limit temperature yet and transmits the voltage control signal VCS at high level through the resistor 28 to the base of the transistor 27 of the voltage control circuit 13. Thus, the transistor 27 is made conductive, so that the base potential of the transistor 25 decreases and the transistor 25 is also made conductive. Next, a high or low level signal is supplied through the resistors 24-1 to 24-N to the bases of the transistors 23-1 to 23-N of the voltage control circuit 13 in accordance with the N dot data of one column of the dot pattern data corresponding to the input character code. Then, the transistors which receive the high level signals to the bases among the transistors 23-1 to 23-N are selectively made conductive, thereby allowing the DC currents to flow from the power source terminal VM through the transistor 25 to the selected ones of the heating elements 18-1 to 18-N. Thus, the printing is executed on the print paper which was set onto the platen 7 in accordance with the N dot data indicative of one column of the character to be printed corresponding to the input character code. Afterward, when the execution of a similar printing operation is finished in accordance with the N dot data included in each of the M columns of the dot pattern data corresponding to the input character code, while driving the carriage 10 at a constant speed in a wellknown ordinary manner, the printing operation responsive to a single input character code is finished. In this case, the voltage which is applied between both ends of each of the selected ones of the heating elements 18-1 to 18-N is about 8 V.

When it is detected in STEP 1 that the count data CD of the dot counter RA2 has reached the maximum value CDM, the CPU 1 determines that the temperature of the thermal print head 11 is higher than the upper limit temperature, so that the CPU 1 transmits the voltage control signal VCS at a low level through the resistor 28 to the base of the transistor 27 in the voltage control circuit 13. Thus, the transistor 27 is made nonconductive and the transistor 25 is also nonconductive. Next, in a similar manner as above, the signal at a high or low level is transmitted through the resistors 24-1 to 24-N to the bases of the transistors 23-1 to 23-N in the voltage control circuit 13 in accordance with the N dot data included in the N-bit data. Due to this, the transistors which receive the signal at a high level at the bases among the transistors 23-1 to 23-N are selectively made conductive, thereby causing the nc current to flow from the power source terminal VM through the voltage drop diodes 22A and 22B to the selected ones of the heating elements 18-1 to 18-N. Thus, the printing is executed on the print paper which was set onto the platen 7 in accordance with the N dot data representing one column of the character to be printed corresponding to the printing data. In this case, the voltage which is applied between both ends of each of the selected ones of the heating elements 18-1 to 18-N becomes 7.4 to 7.5 V since it is equal to the voltage obtained by subtracting the voltage drop of the two diodes 22A and 22B from the power source voltage VM.

The foregoing maximum value CDM per unit time, for instance, per 0.1 second is preset to the optimum value on the basis of experiments.

Figure 5:
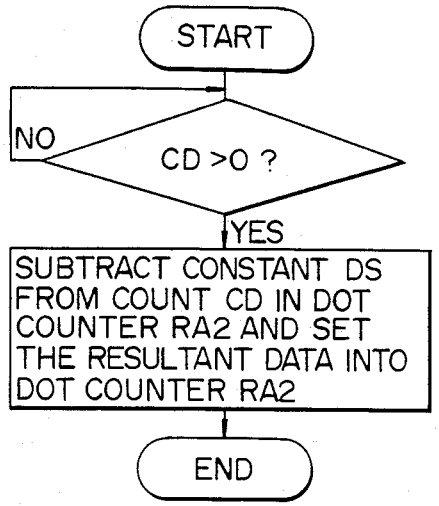
FIG. 5 is a flow chart for explaining the interrupt operation of the CPU.

Further, the CPU 1 is constituted in a manner such that it executes an interrupt processing operation in accordance with a flow chart of FIG. 5 whenever a clock signal of 0.1 second period is interruptingly supplied from the clock generator 17. Namely, when the clock signal is supplied from the clock generator 17, the CPU 1 checks if the count data CD in the dot counter RA2 corresponding to the total number of dots which have already been printed is positive. After confirming that the count data CD is positive, the CPU 1 subtracts a predetermined constant DS such as 10 from the count data CD and finishes this interrupt processing operation. The foregoing constant DS is set as a mean value of the total number of dots constituting the total characters which are printed within one period (0.1 second) of the clock signal.

In the thermal dot type printing apparatus constituted in this way, the total number D of heating elements which are needed to print the N-bit dot data in each column of the character designated by the input character code, namely, the number of dot data "1" included in this N-bit dot data, is added to the count data CD of the dot counter RA2 in the RAM 3 and whenever the clock signal from the clock generator 17 is supplied as an interrupt signal, the constant DS is subtracted from the count data CD. Therefore, when it is assumed that the mean value of the number of dots per unit time which were printed until the previous interrupting signal is generated is nearly equal to the constant DS, the count data CD of the counter RA2 immediately before the next interrupting signal is generated and the constant DS is subtracted, will roughly represent the total number of the heating elements energized in a unit time of 0.1 second. When the count data CD becomes higher than the maximum value CDM upon inputting of the character code, a voltage which is applied when the respective heating elements 18-1 to 18-N of the thermal print head 11 are energized is reduced from an ordinary 8.0 V to about 7.4 to 7.5 V. Therefore, it is possible to prevent that the temperature of the thermal print head 11 excessively increases, so that this makes it possible to avoid that the printed dot character becomes unclear and that the print ribbon will melt due to the heat and be welded and deposited on a portion of the print head or on the print paper.

In addition, since the clock generator 17 and voltage control circuit 13 can be simply constituted using electronic parts such as an IC, the manufacturing cost of the overall printing apparatus can be reduced as compared with conventional printing apparatuses using a temperature detecting element, temperature detecting circuit, etc. Also, there is no need to slow down printing speed in response to the increase in temperature of the thermal print head 11.

Therefore, in the thermal dot type printing apparatus of the embodiment, the print quality and printing speed can be improved with a low-priced apparatus.

Figure 6:
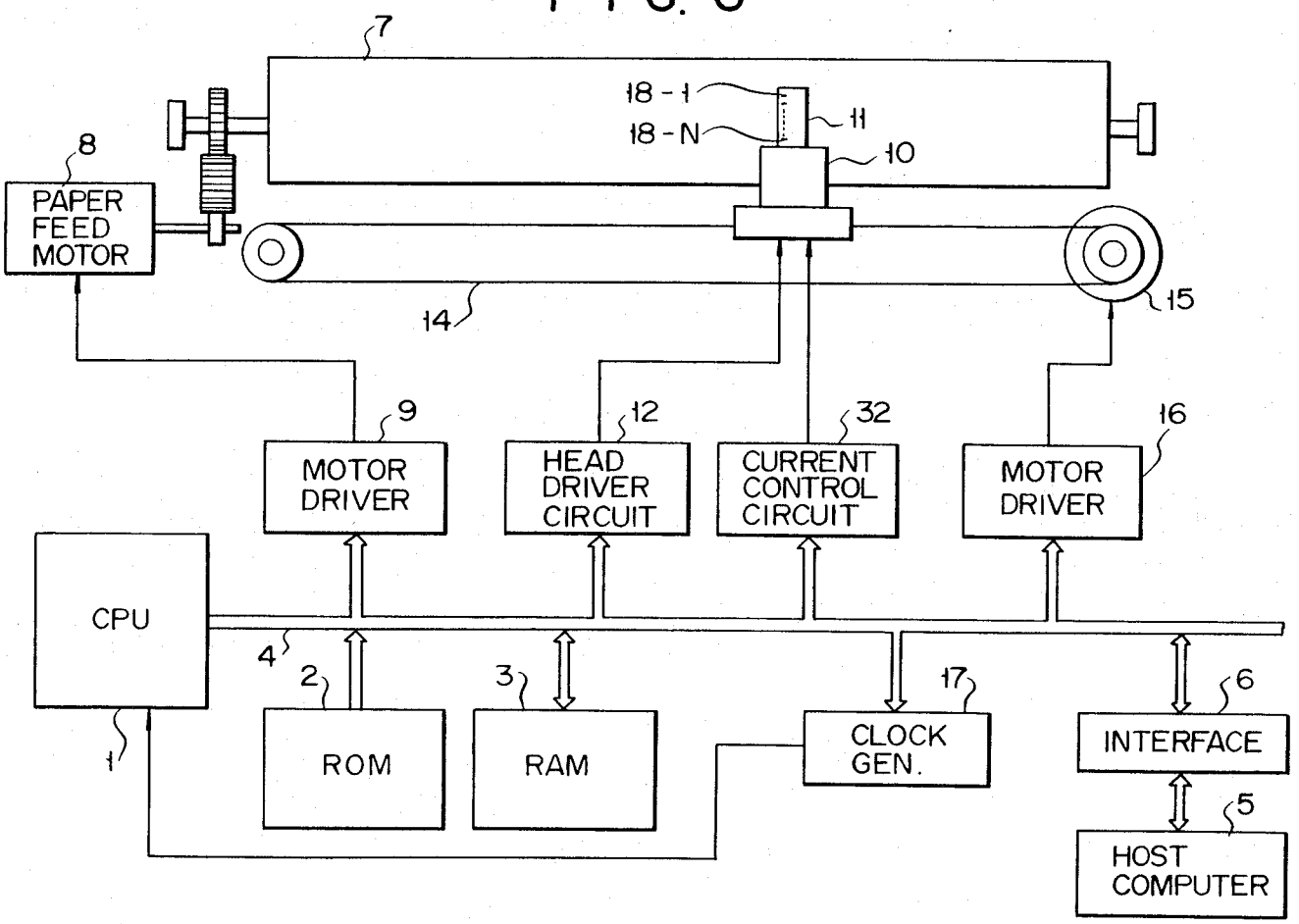
FIG. 6 shows a thermal dot type printing apparatus according to another embodiment of the invention.

FIG. 6 shows a thermal dot type printing apparatus of another embodiment of the present invention, in which the same parts and components as those shown in FIG. 1 are designated by the same reference numerals and the descriptions of the same portions are omitted.

Figure 7:
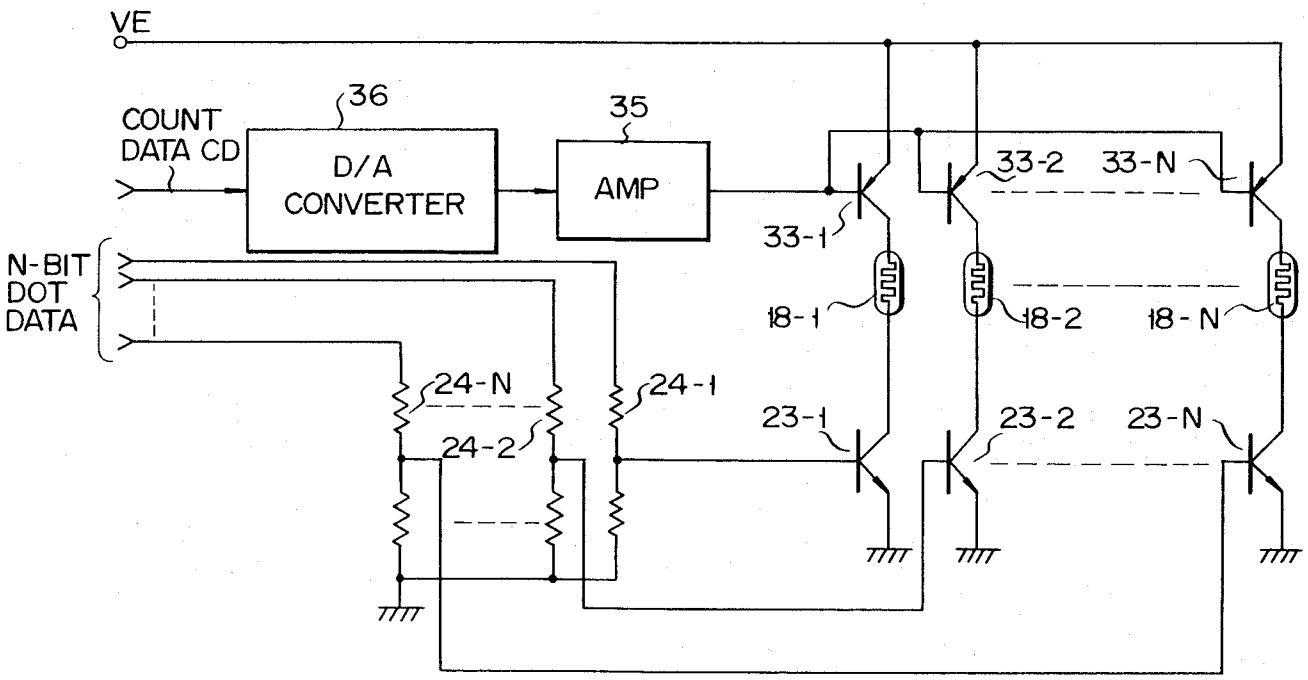
FIG. 7 is a circuit diagram of a voltage control circuit for use in the printing apparatus shown in FIG. 6.

In this embodiment, in place of the voltage control circuit 13, a current control circuit 32 is used. In this circuit 32, emitters of pnp transistors 33-1 to 33-N are connected to a power source terminal VE to which a DC voltage is supplied as shown in FIG. 7. One end of each of the heating elements 18-1 to 18-N of the thermal print head 11 is connected to each collector of the transistors 33-1 to 33-N. The other ends of the heating elements 18-1 to 18-N are grounded through collector-emitter paths of the switching transistors 23-1 to 23-N, respectively. Bases of the transistors 33-1 to 33-N are connected to an output terminal of an amplifier 35 for amplifying an output signal from a D/A converter 36 for converting the 16-bit count data CD which is supplied from a dot memory 31 into an analog value. Thus, the transistors 33-1 to 33-N act as current sources for respectively supplying the currents whose current levels are controlled in response to an output signal of the amplifier 35 to the heating elements 18-1 to 18-N. The N-bit dot data including the N dot data is inputted through the resistors 24-1 to 24-N to the bases of the transistors 23-1 to 23-N as mentioned above.

In the thermal dot type printing apparatus, whenever the CPU 1 receives the character code, the CPU 1 supplies the count data CD set in the dot counter RA2 of the RAM 3 to the D/A converter 36 of the voltage control circuit 32. Therefore, the analog signal responsive to this count data CD is applied to the bases of the transistors 33-1 to 33-N through the amplifier 35. Since the conduction resistances of the transistors 33-1 to 33-N change in proportion to this analog signal, the current which is almost inversely proportional to the foregoing analog signal flows through the collectors of these transistors. Therefore, when the dot data at a high level or "1" level is applied to the bases of the selected transistors among the transistors 23-1 to 23-N, a current which is almost inversely proportional to the count data CD is allowed to flow through the heating elements coupled to the selected transistors 23-1 to 23-N.

In this thermal dot type printing apparatus the current which is almost inversely proportional to the count data CD representative of the number of dots which were printed in a unit time, e.g., 0.1 second is supplied to selected heating elements among the heating elements 18-1 to 18-N, so that an effect similar to that in the foregoing embodiment can be derived.

Particularly, in this embodiment, the voltage value upon energization of each of the heating elements 18-1 to 18-N is set to be inversely proportional to the count data CD; therefore, the temperature of the thermal print head 11 can be kept constant, the print concentration can be made uniform and the print quality can be improved.

The present invention is not limited to the foregoing embodiments. In the first embodiment, the value of the voltage which is applied to the heating elements is changed when the count data CD reaches a predetermined value; however, the current flowing through the heating elements may be directly varied using, for example, current sources which are controlled in accordance with the count data CD. In addition, as shown in the second embodiment, a voltage which gradually varies in response to the count data CD may be applied to the heating elements 18-1 to 18-N. After all, in place of the voltage control circuit 13 or current control circuit 32, it is possible to use any control circuit which can control the amount of current flowing through the heating elements 18-1 to 18-N in accordance with the count data CD.

Also, it is possible to adopt another arrangement such that a predetermined value is stored in the counter RA2 and the number of dot data "1" included in the N-bit dot data in each column of the character to be printed is counted down and upon interrupt operation, the constant DS is added. However, in this case, when the count value of the counter RA2 becomes smaller than the predetermined lowest value in the first embodiment, the CPU 1 supplies the control signal VCS at a low level to the voltage control circuit 13, thereby decreasing the voltage which is applied to the heating elements 18-1 to 18-N.

What is claimed is:

1. A thermal dot type printing apparatus, comprising:

a thermal head having N heating elements arranged in a line;

transfer means for moving said thermal head in a printing direction;

head driver means for allowing current to selectively flow through said heating elements in accordance with N-bit dot data to establish a printing cycle in which dots corresponding to the selected heating elements in said line are printed;

means for setting a predetermined fixed unit time during which time a certain number of said printing cycles are effected;

counting means for counting in a first counting direction the total number of said heating elements energized by said head driver means during said fixed unit time; and control means for sequentially supplying a plurality of N-bit dot data constituting character data to be printed to said head driver means, and for supplying a control signal in accordance with count data determined by said counting means to said head driver means, so that current supplied by said driver means upon each said printing cycle to said heating elements is set in accordance with a change in the total number of said heating elements which have been energized in said fixed unit time.

2. A printing apparatus according to claim 1, said counting means comprising a counter for counting in the first counting direction the total number of the energized heating elements and clock generating means for generating a clock signal of a constant period, and wherein said control means makes the count value of said counter change by a predetermined value in a second counting direction opposite to said first counting direction at every said constant period in response to a clock signal from said clock generating means.

3. A printing apparatus according to claim 2, wherein said head driver means comprises a head driver circuit coupled to said N heating elements between a circuit point and a reference potential terminal, for allowing current to selectively flow through said heating elements in accordance with said N-bit dot data; and a voltage control circuit coupled between a power source terminal and said circuit point, for controlling the voltage at said circuit point in accordance with said control signal.

4. A printing apparatus according to claim 3, wherein said head driver circuit is constituted by N first switching circuits which are respectively connected in series to said N heating elements and whose conduction states are controlled in accordance with said N-bit dot data.

5. A printing apparatus according to claim 4, wherein said voltage control circuit comprises voltage drop means coupled between said power source terminal and said circuit point; and a second switching circuit which is coupled between said power source terminal and said circuit point and whose conduction state is controlled in response to said control signal.

6. A printing apparatus according to claim 3, wherein said voltage control circuit comprises voltage drop means coupled between said power source terminal and said circuit point; and a second switching circuit which is coupled between said power source terminal and said circuit point and whose conduction state is controlled in response to said control signal.

7. A printing apparatus according to claim 1, wherein said head driver means comprises a head driver circuit coupled to said N heating elements between a circuit point and a reference potential terminal, for allowing the current to selectively flow through said heating elements in accordance with said N-bit dot data; and a voltage control circuit coupled between a power source terminal and said circuit point, for controlling the voltage at said circuit point in accordance with said control signal.

8. A printing apparatus according to claim 7, wherein said head driver circuit is constituted by N first switching circuits which are respectively connected in series to said N heating elements and whose conduction states are controlled in accordance with said N-bit dot data.

9. A printing apparatus according to claim 8, wherein said voltage control circuit comprises voltage drop means coupled between said power source terminal and said circuit point; and a second switching circuit which is coupled between said power source terminal and said circuit point and whose conduction state is controlled in accordance with said control signal.

10. A printing apparatus according to claim 7, wherein said voltage control circuit comprises voltage drop means coupled between said power source terminal and said circuit point; and a second switching circuit which is coupled between said power source terminal and said circuit point and whose conduction state is controlled in accordance with said control signal.

11. A printing apparatus according to claim 2, wherein said control means generates the count data from said counting means as said control signal, and said head driver means comprises a head driver circuit coupled to said N heating elements between a power source terminal and a reference potential terminal, for allowing current to selectively flow through said heating elements in accordance with said N-bit dot data; and current control means coupled in series relation with said N heating elements between said power source terminal and said reference potential terminal, for controlling the amount of current flowing through said heating elements in accordance with said count data.

12. A printing apparatus according to claim 11, wherein said head driver circuit is constituted by N first switching circuits which are respectively connected in series to said N heating elements and whose conduction states are controlled in accordance with said N-bit dot data.

13. A printing apparatus according to claim 12, wherein said current control means includes a signal generating circuit for generating an analog signal in accordance with said count data; and N variable resistors which are respectively coupled in series to said N heating elements between said power source terminal and said reference potential terminal and whose resistance va1ues are changed in accordance with the analog signal from said signal generating circuit.

14. A printing apparatus according to claim 11, wherein said current control means includes a signal generating circuit for generating an analog signal in accordance with said count data; and N variable resistors which are respectively coupled in series to said N heating elements between said power source terminal and said reference potential terminal and whose resistance values are changed in accordance with the analog signal from said signal generating circuit.

15. A printing apparatus according to claim 1, wherein said control means generates the count data from said counting means as said control signal, and said head driver means comprises a head driver circuit coupled to said N heating elements between a power source terminal and a reference potential terminal, for allowing current to selectively flow through said heating elements in accordance with said N-bit dot data; and current control means coupled in series relation with said N heating elements between said power source terminal and said reference potential terminal, for controlling the amount of current flowing through said heating elements in accordance with said count data.

16. A printing apparatus according to claim 15, wherein said head driver circuit is constituted by N first switching circuits which are respectively connected in series to said N heating elements and whose conduction states are controlled in accordance with said N-bit dot data.

17. A printing apparatus according to claim 16, wherein said current control means includes a signal generating circuit for generating an analog signal in accordance with said count data; and N variable resistors which are respectively coupled in series to said N heating elements between said power source terminal and said reference potential terminal and whose resistance values are changed in accordance with the analog signal from said signal generating circuit.

18. A printing apparatus according to claim 15, wherein said current control means includes a signal generating circuit for generating an analog signal in accordance with said count data; and N variable resistors which are respectively coupled in series to said N heating elements between said power source terminal and said reference potential terminal and whose resistance values are changed in accordance with the analog signal from said signal generating circuit.

* * * * *